US008774683B2

(12) United States Patent
Kubota et al.

(10) Patent No.: US 8,774,683 B2
(45) Date of Patent: Jul. 8, 2014

(54) DEVELOPMENT DEVICE, DEVELOPER CONTAINER, AND IMAGE FORMING APPARATUS

(75) Inventors: Tomohiro Kubota, Osaka (JP); Naoki Nakatake, Hyogo (JP); Yoshiyuki Shimizu, Hyogo (JP); Shoh Tsuritani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 33 days.

(21) Appl. No.: 13/351,391

(22) Filed: Jan. 17, 2012

(65) Prior Publication Data

US 2012/0189350 A1 Jul. 26, 2012

(30) Foreign Application Priority Data

Jan. 26, 2011 (JP) ..... 2011-014216

(51) Int. Cl.

| | |
|---|---|
| ***G03G 15/00*** | (2006.01) |
| *G03G 15/08* | (2006.01) |
| *G03G 15/09* | (2006.01) |

(52) U.S. Cl.

CPC ..... *G03G 15/00* (2013.01); *G03G 15/0822* (2013.01); *G03G 15/039* (2013.01); *G03G 15/09* (2013.01); *G03G 2215/0822* (2013.01); *G03G 2215/0838* (2013.01)

USPC ..... 399/254

(58) Field of Classification Search

CPC ..... G03G 15/08

USPC ..... 399/254, 258, 262–263

See application file for complete search history.

(56) References Cited

U.S. PATENT DOCUMENTS

| | | | | |
|---|---|---|---|---|
| 5,887,224 | A | 3/1999 | Mizuishi et al. | |
| 7,979,013 | B2 | 7/2011 | Yoshida et al. | |
| 2009/0162101 | A1 | 6/2009 | Yoshida et al. | |
| 2009/0169265 | A1 | 7/2009 | Yoshida et al. | |
| 2011/0064473 | A1 | 3/2011 | Fujita et al. | |
| 2011/0188896 | A1* | 8/2011 | Sakaya et al. | 399/263 |
| 2011/0217055 | A1 | 9/2011 | Takehara et al. | |

FOREIGN PATENT DOCUMENTS

| | | | |
|---|---|---|---|
| CN | 1182893 | A | 5/1998 |
| CN | 1204786 | A | 1/1999 |
| CN | 1306228 | A | 8/2001 |
| CN | 101135878 | A | 3/2008 |

(Continued)

OTHER PUBLICATIONS

U.S. Appl. No. 13/352,732, filed Jan. 18, 2012, Kubota, et al.

(Continued)

*Primary Examiner* — Clayton E Laballe
*Assistant Examiner* — Kevin Butler
(74) *Attorney, Agent, or Firm* — Oblon, Spivak, McClelland, Maier & Neustadt, L.L.P.

(57) ABSTRACT

A development device includes a housing for containing developer, a developer bearer to carry by rotation the developer contained in the housing to a development range position facing a latent image bearer, and developer conveyance device that includes a rotary shaft, a conveyance blade extending axially along the rotary shaft, projecting from the rotary shaft, and extending obliquely to the rotary shaft, to transport developer as the rotary shaft rotates, and a flexible agitation blade provided to the rotary shaft. An axial range of the flexible agitation blade overlaps at least partially with that of the conveyance blade. The flexible agitation blade has a width wider than a width of the conveyance blade and extends beyond an outer edge of the conveyance blade in the direction of diameter of the rotary shaft.

22 Claims, 6 Drawing Sheets

(56) References Cited

FOREIGN PATENT DOCUMENTS

| | | | | | |
|---|---|---|---|---|---|
| CN | 101290502 | A | | 10/2008 | |
| CN | 101303555 | A | | 11/2008 | |
| CN | 101887226 | A | | 11/2010 | |
| JP | 8-171278 | | | 7/1996 | |
| JP | 11-15272 | | | 1/1999 | |
| JP | 1999-015272 | | * | 1/1999 | ..... G03G 15/08 |
| JP | 2002-40772 | | | 2/2002 | |
| JP | 2002-040772 | | * | 2/2002 | ..... G03G 15/08 |
| JP | 2006-178381 | | | 7/2006 | |
| JP | 2006-276535 | | | 10/2006 | |
| JP | 2008-129210 | | | 6/2008 | |
| JP | 2008-242266 | | | 10/2008 | |

OTHER PUBLICATIONS

Combined Chinese Office Action and Search Report Issued May 29, 2013 in Patent Application No. 201210015178.4 (with English translation of Categories of Cited Documents).

Chinese Office Action issued Nov. 14, 2013, in China Patent Application No. 201210015178.4.

* cited by examiner

DEVELOPMENT DEVICE, DEVELOPER CONTAINER, AND IMAGE FORMING APPARATUS

CROSS-REFERENCE TO RELATED APPLICATIONS

This patent application is based on and claims priority pursuant to 35 U.S.C. §119 to Japanese Patent Application No. 2011-014216, filed on Jan. 26, 2011 in the Japan Patent Office, the entire disclosure of which is hereby incorporated by reference herein.

FIELD OF THE INVENTION

The present invention generally relates to a developer conveyance device, and a developer container, a development device, a process unit, and an image forming apparatus including a developer conveyance device.

BACKGROUND OF THE INVENTION

In general, electrophotographic image forming apparatuses such as copiers, printers, facsimile machines, or multifunction machines including at least two of these functions include a development device to develop latent images formed on an image bearer with developer, and a toner container for containing toner. As the toner in the development device is consumed in image development, fresh toner is supplied from the toner container to the developer in the development device. If mixing of the toner supplied from the toner container and the developer in the development device is insufficient, the ratio of supplied toner in the developer becomes uneven between a portion adjacent to a toner supply inlet formed in the development device and other portions inside the development device. In such a state, it is possible that image density becomes uneven or toner scatters in the backgrounds of output images.

Therefore, developer is typically circulated inside the development device to equalize the ratio of supplied toner in the developer inside the development device (i.e., development housing). For example, U.S. Pat. No. 5,887,224-A, JP-2006-276535-A, and JP-2008-129210-A) propose configurations in which the interior of the development housing is divided into first and second compartments that communicate with each other in both axial end portions, and first and second rotary conveyance screws (collectively, "conveyance screws") are provided in the first and second compartments, respectively, to transport the developer therein.

The conveyance screws transport the developer in the respective compartments in the opposite directions, and the developer transported to an axial end portion in one compartment is transported through the communication portion to the other compartment. Then, the developer is transported by the conveyance screws in the first and second compartments to the opposite axial end portions, respectively, after which the developer is returned through the communication portions to the compartment where the developer was originally. The developer can be circulated between the first and second compartments by repeating this operation. Accordingly, the supplied toner can be mixed with the developer present in the development device, and the ratio of supplied toner to the existing developer can become uniform.

In such configurations, any contact of the rotary conveyance screw with the inner wall of the development housing can generate noise and cause wear of the conveyance screw as well as the inner wall of the development housing. Therefore, a certain clearance or gap is generally provided between the edge of the conveyance screw and the inner wall of the development housing. The size of the gap includes a margin for error in view of dimensional tolerance of the development housing and the conveyance screw, runout of the conveyance screw, and the like.

A drawback of the above-described arrangement, however, is that the conveyance screw cannot convey the developer in the gap between the conveyance screw and the inner wall of the development housing, allowing the developer to remain in the gap. If the developer thus accumulates locally, the amount of developer circulating in the development device is smaller than the amount of developer contained therein.

Additionally, although toner is degraded gradually as toner particles contact each other while being circulated, when the amount of developer circulating is smaller, the number of times toner particles contact each other increases, thus accelerating degradation of toner. Therefore, allowing developer to accumulate in the gap can accelerate degradation of toner.

In view of the foregoing, various approaches have been tried to prevent developer from accumulating in the development housing.

For example, in JP-2008-129210-A, a flexible agitation blade is configured to slide along the inner wall of the development housing to prevent the developer from adhering to the inner wall of the development housing. Although noise and wear caused by the flexible agitation blade can be reduced compared with the conveyance screw, this approach, however, has a drawback in that the agitation blade is not capable of transporting the developer axially. Accordingly, if the spiral blade of the conveyance screw is replaced with the agitation blade, it is possible that conveyance of developer is degraded in that portion.

Additionally, JP-2008-242266-A proposes a development device in which both a conveyance blade capable of transporting developer axially and an agitation blade to prevent the developer from adhering to the inner wall of the development housing are provided in an identical area. Although this approach is effective, the configuration is complicated and costly.

BRIEF SUMMARY OF THE INVENTION

In view of the foregoing, one embodiment of the present invention provides a developer conveyance device that includes a rotary shaft, a conveyance blade extending axially along the rotary shaft and projecting from the rotary shaft, and a flexible agitation blade provided to the rotary shaft. The conveyance blade is oblique to the rotary shaft to transport developer as the rotary shaft rotates. An axial range of the flexible agitation blade overlaps at least partially with an axial range of the conveyance blade. The flexible agitation blade has a width, which is a length in the direction of diameter of the rotary shaft, wider than a width of the conveyance blade and extends beyond an outer edge of the conveyance blade in the direction of diameter of the rotary shaft.

In another embodiment, a development device for developing a latent image formed on a latent image bearer includes a housing for containing developer, a developer bearer to carry by rotation the developer contained in the housing to a development range position facing the latent image bearer, and the developer conveyance device described above.

Yet in another embodiment, a developer container for containing developer supplied to a development device includes the developer conveyance device described above.

Yet in another embodiment, an image forming apparatus includes the development device and the developer container described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
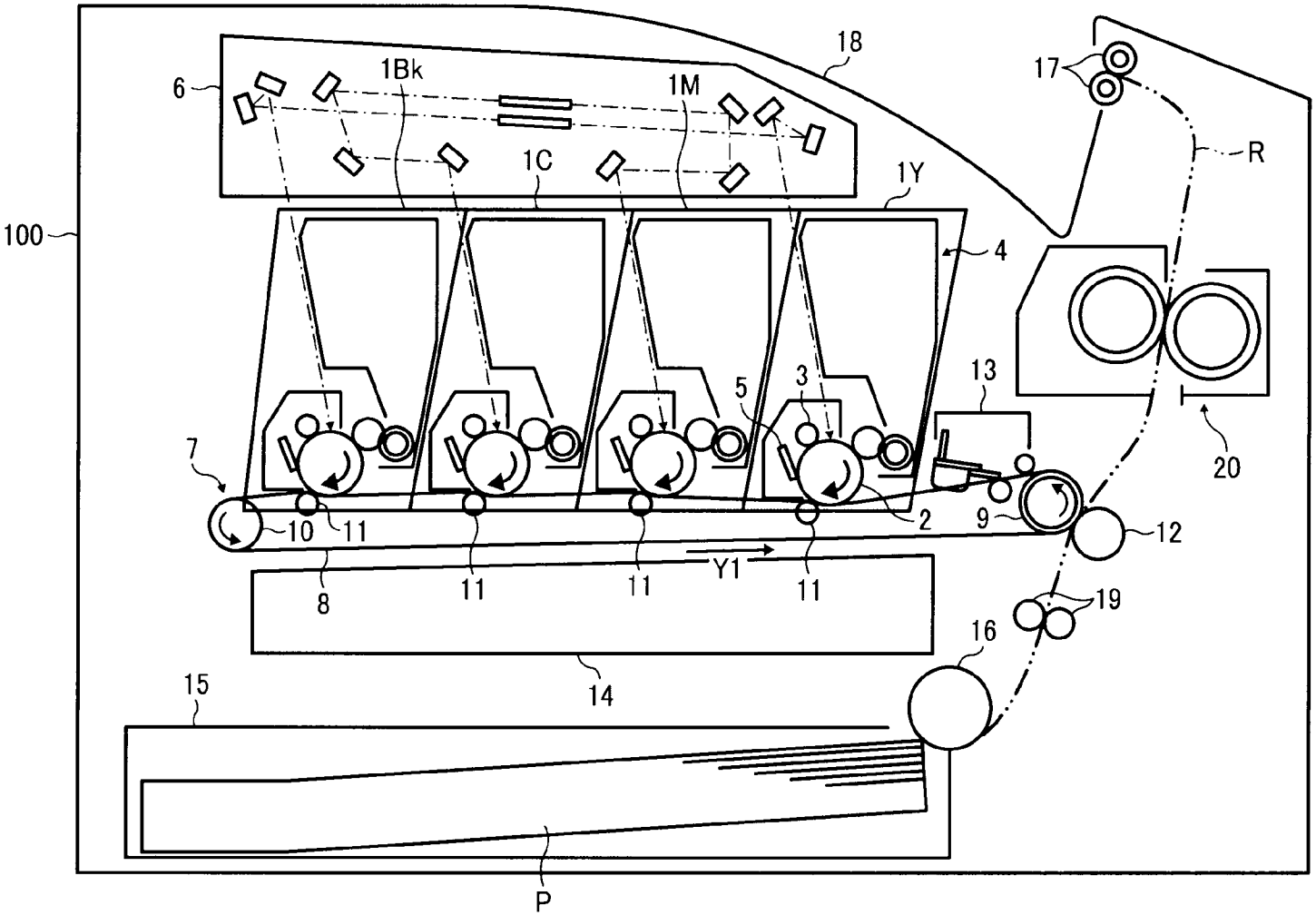
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and Bk attached to each reference numeral indicate only that components indicated thereby are used for forming yellow, magenta, cyan, and black images, respectively, and hereinafter may be omitted when color discrimination is not necessary.

FIG. 1 schematically illustrates a configuration of an image forming apparatus 100 according to the present embodiment.

The image forming apparatus 100 shown in FIG. 1 can be, for example, a multicolor laser printer and includes four process units 1Y, 1M, 1C, and 1Bk removably installable in an apparatus body thereof. The process units 1Y, 1M, 1C, and 1Bk respectively contain yellow (Y), magenta (M), cyan (C), and black (Bk) developer corresponding to decomposed color components of full-color images and have a similar configuration except the color of developer contained therein. It is to be noted that one-component developer consisting essentially of toner particles is used in the present embodiment.

More specifically, each process unit 1 includes a drum-shaped photoreceptor 2 serving as a latent image bearer, a charging device including a charging roller 3 to charge the surface of the photoreceptor 2, a development device 4 to supply toner to the surface of the photoreceptor 2, and a cleaning unit including a cleaning blade 5 to clean the surface of the photoreceptor 2. It is to be noted that, in FIG. 1, the photoreceptor 2, the charging roller 3, the development device 4, and the cleaning blade 5 of only the process unit 1Y for yellow are given reference numerals, and reference numerals of those of the other process units 1M, 1C, and 1Bk are omitted.

Additionally, an exposure unit 6 is provided above the process units 1 in FIG. 1 to expose to light the surface of each photoreceptor 2. The exposure unit 6 includes a light source, a polygon mirror, an f-θ lens, and reflection mirrors, and is configured to direct a laser beam onto the surface of the photoreceptor 2 according to image data.

Additionally, a transfer device 7 is provided beneath the process units 1. The transfer device 7 includes an intermediate transfer belt 8 that can be, for example, an endless belt onto and from which an image is transferred. The intermediate transfer belt 8 is stretched around support rollers, namely, a driving roller 9 and a driven roller 10. As the driving roller 9 rotates counterclockwise in FIG. 1, the intermediate transfer belt 8 rotates in the direction indicated by arrow Y1 shown in FIG. 1.

The image forming apparatus 100 further includes four primary-transfer rollers 11 positioned facing the respective photoreceptors 2 via the intermediate transfer belt 8. Each primary-transfer roller 11 is pressed against an inner circumferential surface of the intermediate transfer belt 8, thus forming a primary-transfer nip between the intermediate transfer belt 8 and the corresponding photoreceptor 2. Each primary-transfer roller 11 is electrically connected to a power source and receives a predetermined amount of voltage including at least one of direct-current (DC) voltage and alternating current (AC) voltage.

Additionally, a secondary-transfer roller 12 is provided at a position facing the driving roller 9 via the intermediate transfer belt 8. The secondary-transfer roller 12 is pressed against an outer circumferential surface of the intermediate transfer belt 8, and thus a secondary-transfer nip is formed between the secondary-transfer roller 12 and the intermediate transfer belt 8. Similarly to the primary-transfer rollers 11, the secondary-transfer roller 12 is electrically connected to a power source and receives a predetermined amount of voltage including at least one of DC voltage and AC voltage.

Additionally, a belt cleaning unit 13 to clean the surface of the intermediate transfer belt 8 is provided facing a right end portion of the intermediate transfer belt 8 from the outer circumferential side in FIG. 1. A waste toner conveyance hose (tube) is connected to the belt cleaning unit 13 as well as an inlet of a waste toner container 14 provided beneath the transfer device 7.

The image forming apparatus 100 further includes a sheet cassette 15 for containing sheets P of recording media such as paper or overhead projector (OHP) films, provided beneath the apparatus body, a pair of discharge rollers 17, and a discharge tray 18. The sheet cassette 15 is provided with a feed roller 16 to pick up and transport the sheets P from the sheet cassette 15. The pair of discharge rollers 17 is positioned in an upper portion of the apparatus body to discharge the sheets P outside the image forming apparatus 100, and the sheets P thus discharged are stacked on the discharge tray 18 formed on an upper surface of the apparatus body.

A conveyance path R is formed inside the apparatus body, and the sheet P is conveyed from the sheet cassette 15 to the secondary-transfer nip and further to the discharge tray 18 along the conveyance path R. The image forming apparatus 100 further includes a pair of registration rollers 19 positioned upstream from the secondary-transfer roller 12 in the direction in which the sheet P is transported (hereinafter "sheet conveyance direction") and a fixing device 20 positioned downstream from the secondary-transfer roller 12 in that direction. Additionally, the image forming apparatus 100 includes a controller including, for example, a central processing unit (CPU), to control operations of the respective components.

The image forming apparatus 100 configured as described above operates as follows.

When image formation is started, the photoreceptors 2 in the respective process units 1 are rotated clockwise in FIG. 1, and the charging rollers 3 uniformly charge the surfaces of the photoreceptors 2 to a predetermined polarity. Then, the exposure unit 6 directs laser beams onto the charged surfaces of the respective photoreceptors 2 according to, for example, image data of originals read by a reading unit. Thus, electrostatic latent images are formed on the respective photoreceptors 2. More specifically, the exposure unit 6 directs the laser beams according to single color data, namely, yellow, cyan, magenta, and black color data decomposed from full-color image data to the surfaces of the photoreceptors 2. The electrostatic latent images formed on the photoreceptors 2 are developed into toner images with toner supplied by the respective development devices 4.

Meanwhile, the driving roller 9 rotates, and accordingly the intermediate transfer belt 8 rotates in the direction indicated by arrow Y1 shown in FIG. 1. The predetermined voltage (i.e., transfer bias voltage), polarity of which is the opposite that of toner, is applied to the respective primary-transfer rollers 11, thus forming transfer electrical fields in the primary-transfer nips between the primary-transfer rollers 11 and the photoreceptors 2. The transfer bias voltage may be a constant voltage or voltage controlled in constant-current control method. The transfer electrical fields generated in the primary-transfer nips transfer the toner images from the respective photoreceptors 2 and superimpose them one on another on the intermediate transfer belt 8. Thus, a multicolor toner image is formed on the intermediate transfer belt 8. After primary transfer, the cleaning blades 5 remove toner remaining on the respective photoreceptors 2.

Additionally, when image formation is started, the feed roller 16 rotates, thereby transporting the sheet P from the sheet cassette 15. Then, the registration rollers 19 forward the sheet P to the secondary-transfer nip formed between the secondary-transfer roller 12 and the intermediate transfer belt 8, timed to coincide with the multicolor toner image formed on the intermediate transfer belt 8. At that time, the transfer bias voltage whose polarity is opposite that of the toner image on the intermediate transfer belt 8 is applied to the secondary-transfer roller 12, and thus the transfer electrical field is formed in the secondary-transfer nip. The transfer electrical field generated in the secondary-transfer nip transfers the superimposed toner images from the intermediate transfer belt 8 onto the sheet P at a time. Subsequently, the sheet P enters the fixing device 20, and the toner image is fixed thereon. The pair of discharge rollers 17 discharges the sheet P onto the discharge tray 18.

It is to be noted that, although the description above concerns multicolor image formation, alternatively, the image forming apparatus 100 can form single-color images, bicolor images, or three-color images using one, two, or three of the four process units 1.

Figure 2:
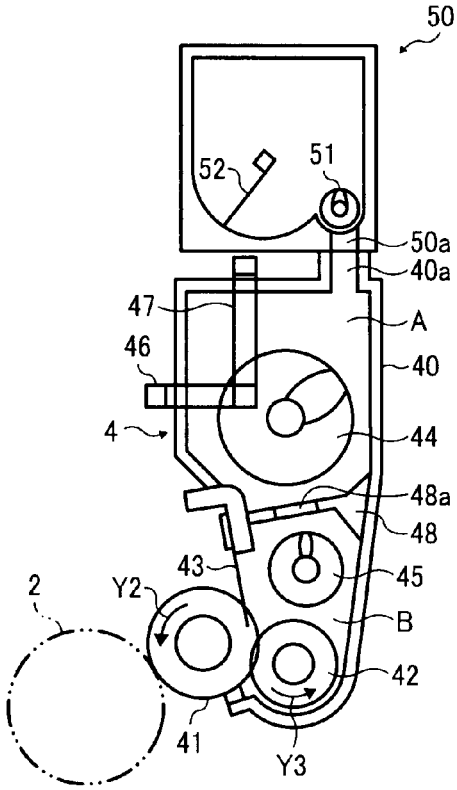
FIG. 2 is a schematic end-on axial view of a development device and a toner cartridge.

FIG. 2 is a schematic end-on axial view of the development device 4 and a toner cartridge 50.

As shown in FIG. 2, the development device 4 according to the present embodiment includes a development housing 40 in which developer containing compartments A and B are formed, a development roller 41 serving as a developer bearer, a supply roller 42 serving as a developer supply member to supply toner to the development roller 41, a doctor blade 43 serving as a developer regulator to adjust the amount of toner carried on the development roller 41, and first and second developer conveyance members 44 and 45 to transport the developer (toner).

The development roller 41 includes a metal core and an electroconductive elastic layer made of, for example, rubber, overlying the metal core. In the present embodiment, for example, the metal core has an external diameter of 6 mm, and the electroconductive elastic layer has an outer diameter of 12 mm and JIS hardness (Hs) of 75. Additionally, the electroconductive elastic layer is designed to have a volume resistivity of about $10^5\Omega$ to $10^7\Omega$. For example, electroconductive urethane rubber or silicone rubber may be used for the electroconductive elastic layer. The development roller 41 rotates counterclockwise in FIG. 2 as indicated by arrow Y2 and transports the developer carried thereon to a position facing the doctor blade 43 and a position facing the photoreceptor 2.

Typically, a sponge roller can be used as the supply roller 42. The sponge roller including a metal core and semiconducting foam polyurethane adhering to the metal core is preferable. Foam polyurethane can be made semiconducting by mixing carbon therein. In the present embodiment, the metal core of the supply roller 42 has an external diameter of about 6 mm, and the sponge layer has an external diameter of about 12 mm, for example. The supply roller 42 is disposed in contact with the development roller 41. The size of the nip formed between the supply roller 42 and the development roller 41 in contact with each other is preferably about 1 mm to 3 mm. In the present embodiment, the nip has a length of about 2 mm.

The supply roller 42 rotates counterclockwise in FIG. 2 as indicated by arrow Y3 and can transport the toner in the development housing 40 to the outer layer of the development roller 41 efficiently by rotating in the counter direction to the direction in which the development roller 41 rotates. It is to be noted that, in the present embodiment, the ratio of rotational frequency of the supply roller 42 to that of the development roller 41 is 1 so that toner can be supplied reliably.

The doctor blade 43 can be constructed of, for example, a planar metal having a thickness of about 0.1 mm. Steel used stainless (SUS) metal may be used for the doctor blade 43. An end of the doctor blade 43 is disposed in contact with the surface of the development roller 41. When the toner passes through the nip between the doctor blade 43 and the development roller 41 (i.e., regulation nip), the amount (layer thickness) of the toner supplied by the supply roller 42 onto the development roller 41 is adjusted, and the toner is frictionally charged simultaneously.

The amount of toner carried on the development roller 41 is adjusted for stable developability and satisfactory image quality. Accordingly, in commercial products, the pressure with which the doctor blade 43 contacts the development roller 41 and the position of the regulation nip are maintained strictly. For example, the contact pressure of the doctor blade 43 against the development roller 41 is about 20 N/m to 60 N/m, and the regulation nip is positioned about 0.5±0.5 mm from the tip of the doctor blade 43. These parameters can be determined in accordance with properties of toner, the development roller, and the supply roller.

For example, in the present embodiment, the doctor blade 43 is constructed of a SUS metal having a thickness of 0.1 mm, disposed in contact with the development roller 41 with a pressure of 45 N/m, and the regulation nip is positioned 0.2 mm from the tip of the doctor blade 43. The length from a fixed end of the doctor blade 43 to the free end is 14 mm to form a uniform thin toner layer on the development roller 41.

Further, the development housing 40 is provided with first and second light guides 46 and 47 that are components of a detector (developer amount detector) to detect the amount of toner remaining in the development housing 40. The amount of toner remaining in the development housing 40 can be detected using a light transmissive detection method. More specifically, the toner amount detector includes a light-emitting element and a light receiving element. The first light guide 46 guides the light emitted from the light-emitting element inside the development housing 40, and the second light guide 47 further guides the light to the light receiving element. Thus, a light path is formed. An end of the first light guide 46 from which light comes out is positioned at a predetermined distance from an end of the second light guide 47 from which the light enters therein.

With this configuration, when the amount of toner in the development housing 40 is sufficient, the light is blocked by the toner present in the gap between the first and second light guides 46 and 47, and the light receiving element does not receive the light. However, as the toner is consumed in printing, the level of the toner in the development housing 40 descends below the first and second light guides 46 and 47, that is, no toner is present in the gap between the first and second light guides 46 and 47. Accordingly, the light reaches the light receiving element. The controller can recognize that the level of the toner in the development housing 40 is below the first and second light guides 46 and 47 with the value output from the light receiving element at that time.

The first and second light guides 46 and 47 are constructed of materials of good light permeability. For example, resins of high transparency, such as acrylic resin or polycarbonate (PC), are suitable. Alternatively, optical glass that can attain better optical characteristics may be used for the first and second light guides 46 and 47. Yet alternatively, optical fibers may be used for the first and second light guides 46 and 47. In this case, design flexibility of the light path can be improved.

Additionally, the toner cartridge 50 serving as a developer container is provided above the development housing 40 and removably connected thereto. It is to be noted that the development device 4 and the toner cartridge 50 are not limited to the configurations shown in FIG. 2. For example, the development device 4 and the toner cartridge 50 may be united as a single unit, or the development device 4, the toner cartridge 50, and the photoreceptor 2 may be housed in a common unit casing as a process unit.

A supply port (toner outlet) 50*a* is formed in a bottom portion of the toner cartridge 50, and a supply port (toner inlet) 40*a* is formed in an upper portion of the development housing 40 to supply toner from the toner cartridge 50 to the development housing 40. Additionally, a third developer conveyance member 51 and an agitator 52 are rotatably provided inside the toner cartridge 50. The third developer conveyance member 51 transports the toner inside the toner cartridge 50 to the toner outlet 50*a*, and the agitator 52 transports the toner toward the third developer conveyance member 51.

Toner is supplied to the development housing 40 according to detection results by the above-described toner amount detector to detect the amount of toner remaining in the development housing 40. More specifically, when the toner amount detector determines that the amount of toner inside the development housing 40 has decreased below a predetermined amount, the toner cartridge 50 is driven a predetermined period of time, thereby supplying a predetermined amount of toner to the development housing 40.

Additionally, a partition 48 divides, but not completely, the development housing 40 into a first compartment A in which the toner inlet 40*a* is positioned and a second compartment B in which the development roller 41, the doctor blade 43, and the like are provided. Openings 48*a* are formed in both end portions of the partition 48 as communication portions through which toner moves between the two compartments A and B. Dividing the development housing 40 with the partition 48 can reduce the powder pressure to the supply roller 42 by the toner, thus reducing the load to the supply roller 42. The first and second developer conveyance members 44 and 45 are positioned in the first and second compartments A and B, respectively.

Figure 3:
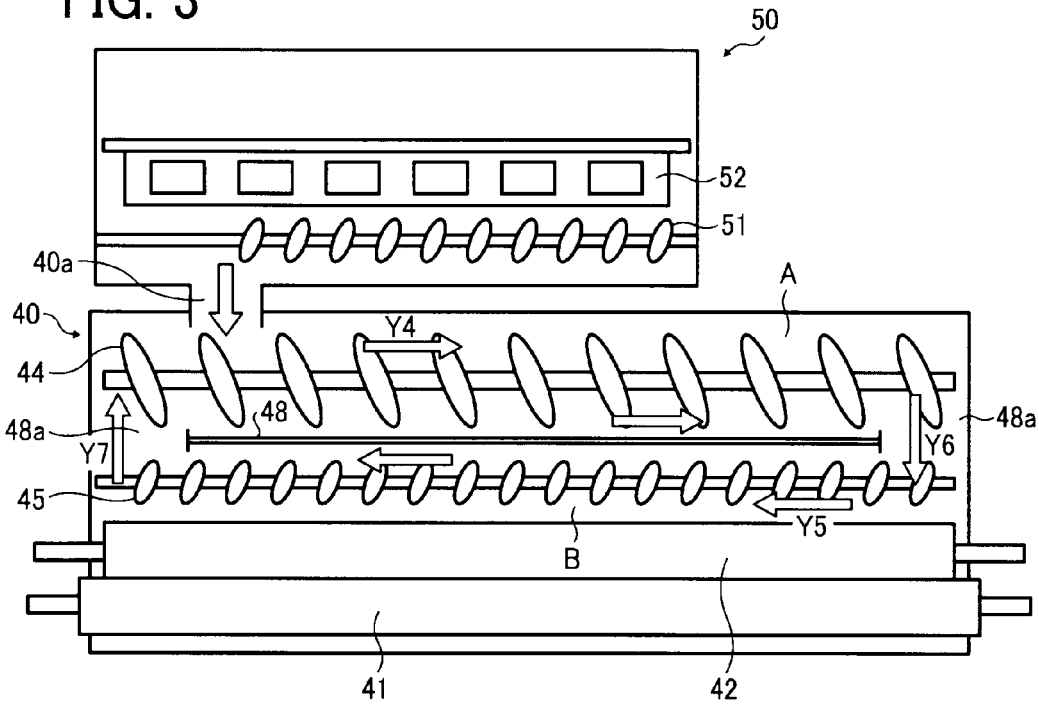
FIG. 3 is a cross-sectional view of the development device and the toner cartridge as viewed from a direction different from that of FIG. 2.

FIG. 3 is a schematic cross-sectional view of the development device 4 and the toner cartridge 50 perpendicular to the surface of the paper on which FIG. 2 is drawn.

As shown in FIG. 3, the first and second developer conveyance members 44 and 45 are positioned substantially facing each other via the partition 48 dividing the first compartment A and the second compartment B from each other. The first compartment A and the second compartment B can communicate with each other via the openings 48*a* formed in both end portions of the partition 48. The first and second developer conveyance members 44 and 45 transport toner axially by rotation. More specifically, the second conveyance member 45 is a conveyance screw including a rotary shaft and a screw blade formed on the rotary shaft. The first developer conveyance member 44 is described in further detail later.

Arrows Y4 through Y7 shown in FIG. 3 indicate the direction of movement of developer (toner). The first and second developer conveyance members 44 and 45 rotate to transport the developer in the opposite directions as indicated by arrows Y4 and Y5. The developer transported to an axial end portion of the first compartment A in the axial direction of the first developer conveyance member 44 cannot be transported further in that direction but be transported through the openings 48*a* to the second compartment B. Similarly, the developer transported to an axial end portion of the second compartment B in the axial direction of the second developer conveyance member 45 cannot be transported further in that direction but be transported through the openings 48*a* to the first compartment A.

Then, the developer is transported by the first and second developer conveyance members 44 and 45 in the first and second compartments A and B to the opposite end portions, respectively, after which the developer is returned through the opening 48*a* to the compartment A or B where the developer was originally. The developer can be circulated between the first compartment A and the second compartment B by repeating this operation.

With the above-described configuration, while circulated between the first compartment A and the second compartment B, the toner supplied from the toner cartridge 50 to the first compartment A can be mixed with the toner present in the development housing 40, and thus, the ratio of supplied toner can be equalized. Accordingly, in the present embodiment, the development conditions can be kept constant even if fresh toner is supplied, preventing color unevenness and scattering of toner in the backgrounds of images.

Additionally, if the distance from the toner inlet 40*a* to the second compartment B in which the development are relatively long, the supplied toner and the developer inside the development housing 40 can be mixed a longer time to mix them sufficiently. That is, if the toner inlet 40*a* is positioned in the first compartment A not the second compartment B, the supplied toner and the developer inside the development housing 40 can be mixed a longer time. More specifically, when the toner inlet 40*a* is positioned on the upstream side in the first compartment A in the developer conveyance direction, the supplied toner and the developer inside the development housing 40 can be mixed better.

Figure 4:
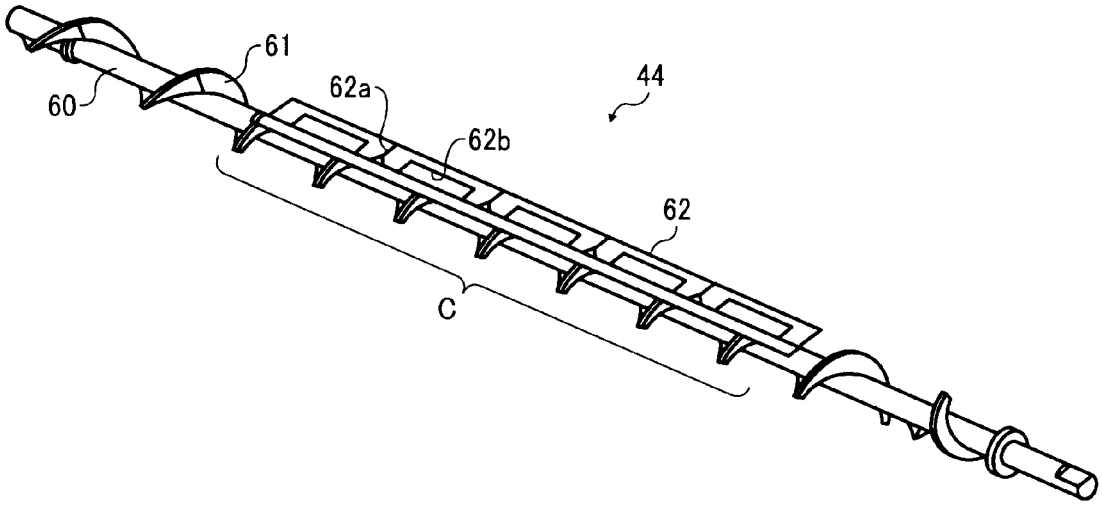
FIG. 4 is a perspective view of a first developer conveyance member.

FIG. 4 is a perspective view of the first developer conveyance member 44.

As shown in FIG. 4, the first developer conveyance member 44 includes a rotary shaft 60, a conveyance blade 61, and an agitation blade 62. The conveyance blade 61 may be a spiral-shaped screw blade winding around the outer circumference of the rotary shaft 60. That is, the conveyance blade 61 extends axially along the rotary shaft 60, projecting from the rotary shaft 60, and is oblique to the rotary shaft 60 to transport developer as the rotary shaft rotates 60. The conveyance blade 61 includes a cutout K (shown in FIG. 5) extending over a predetermined or given angular range in a partial length C of the first developer conveyance member 44, and the agitation blade 62 is provided to the rotary shaft 60 in the cutout K.

It is to be noted that although, in the configuration shown in FIG. 4, the agitation blade 62 is provided not entirely but only partially in the axial range in which the conveyance blade 61 extends, alternatively, the agitation blade 62 may extend entirely across the axial range in which the conveyance blade 61 extends. In other words, the agitation blade 62 overlaps the conveyance blade 61 in the axial direction of the rotary shaft 60 at least partly.

The agitation blade 62 is a flexible member and may be constructed of, for example, a polyethylene terephthalate (PET) sheet. It is to be noted that the agitation blade 62 is not oblique to the rotary shaft 60 and is not capable of transporting toner axially, differently from the conveyance blade 61. Additionally, in the configuration shown in FIG. 4, slits 62*a* and openings 62*b* to let the toner to pass through are formed in the agitation blade 62 to alleviate the load on the agitation blade 62 given by the toner.

Figure 5:
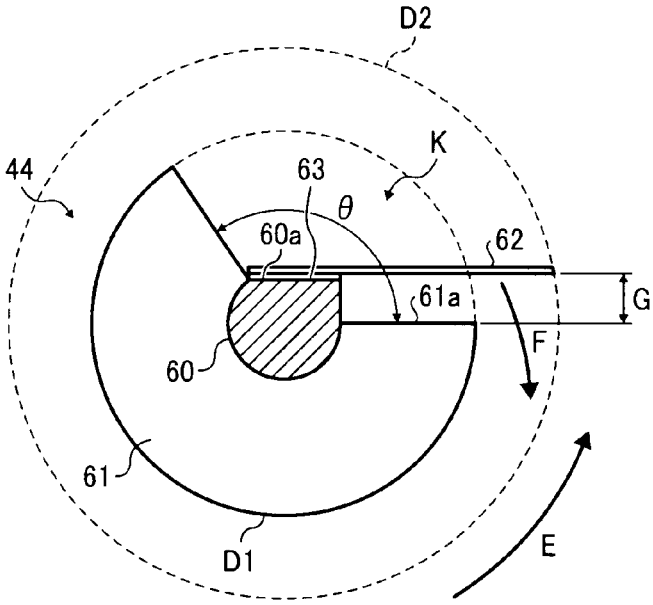
FIG. 5 is a cross-sectional view of the first developer conveyance member perpendicular to the axial direction thereof.

FIG. 5 is a cross-sectional view of the first developer conveyance member 44 perpendicular to the axial direction thereof.

As shown in FIG. 5, the conveyance blade 61 includes the cutout K extending from the outer circumference of the spiral blade to the rotary shaft 60. In other words, the conveyance blade 61 is cut out entirety in the direction of diameter in that angular range in the partial length C. The agitation blade 62 is provided to the rotary shaft 60 in the partial length C in which the cutout K is positioned. By cutting out the spiral blade of the conveyance blade 61 partly in that angular range, the agitation blade 62 can be provided to the rotary shaft 60 without interfering with the conveyance blade 61.

Additionally, the rotary shaft 60 includes a flat face 60*a* in the portion where the agitation blade 62 is provided. In the present embodiment, the agitation blade 62 is attached to the flat face 60*a* with double-sided adhesive tape 63. With this configuration, the agitation blade 62 is less likely to fall off from the rotary shaft 60 and can adhere thereto stably. The agitation blade 62 may be attached to the rotary shaft 60 using a known adhesion method such as gluing, thermal welding, or ultrasonic welding not limited to double-sided adhesive tape.

In FIG. 5, arrow E indicates the direction of rotation of the rotary shaft 60, reference character 61*a* represents an edge face of the conveyance blade 61 positioned upstream from the agitation blade 62 in the direction of rotation of the rotary shaft 60, and reference character D1 represents the outer circumference of the conveyance blade 61. As the rotary shaft 60 rotates in the direction indicated by arrow E, the agitation blade 62 deforms in the opposite direction indicated by arrow F due to the load from the toner.

A predetermined gap (clearance) G is provided between the agitation blade 62 and the edge face 61*a* of the conveyance blade 61 downstream from the agitation blade 62 in the direction in which the agitation blade 62 deforms. That is, the gap G is provided between the agitation blade 62 and the conveyance blade 61 positioned upstream from the agitation blade 62 in the direction of rotation of the rotary shaft 60. Thus, a margin for deformation of the agitation blade 62 is secured with the gap G.

Additionally, the agitation blade 62 extends from the rotary shaft 60 beyond the outer circumference D1 of the conveyance blade 61 as shown in FIG. 5, and the outer circumferential edge of the agitation blade 62 draws a locus D2 indicated by broken lines that is on the outer circumferential side from the outer circumference D1 of the conveyance blade 61. In other words, the agitation blade 62 has a width, which is a length in the direction perpendicular to the axial direction of the rotary shaft 62, wider than that of the conveyance blade 61. With this configuration, the agitation blade 62 can move the toner in a wider area than the area in which the conveyance blade 61 moves the toner.

In the present embodiment, the angular range θ of the cutout K in the direction of rotation (circumferential direction) is less than 180°. In other words, the angular range where the conveyance blade 61 is present is greater than 180° in the direction of rotation of the rotary shaft 60.

Figure 6:
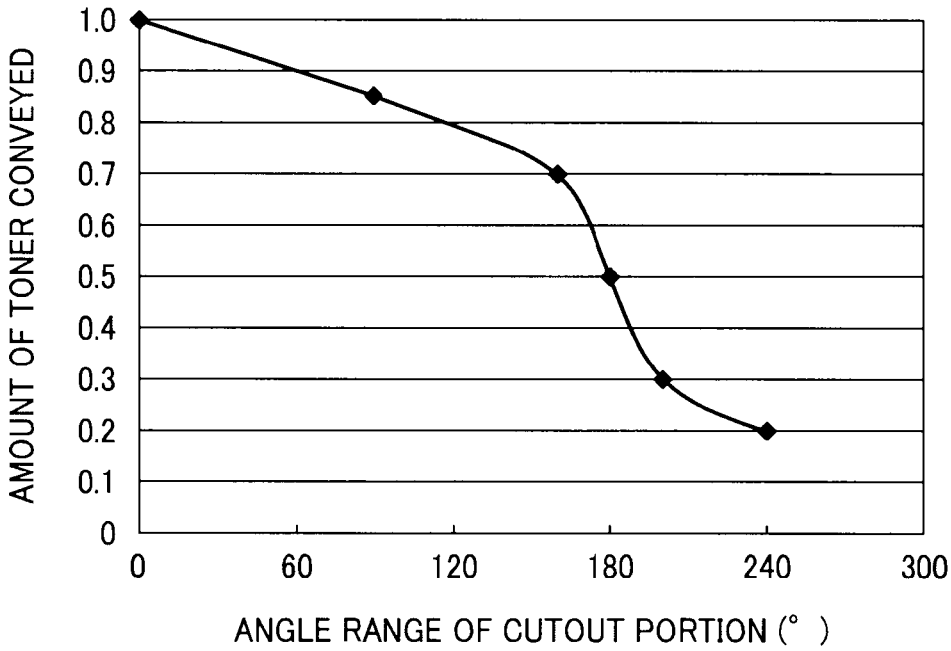
FIG. 6 is a graph illustrating the relation between the angular range of a blade cutout and the amount of developer transported axially.

FIG. 6 is a graph illustrating the relation between the angular range θ of the cutout K and the amount of toner transported axially.

FIG. 6 illustrates results of an experiment performed to examine changes in the amount of toner conveyed axially with changes in the angular range θ of the cutout K in a configuration in which the rotary shaft 60 has an external diameter of 5 mm, the agitation blade 62 has an external diameter of 14 mm, and a pitch of the agitation blade 62 is 20 mm. In FIG. 6, the amount of toner conveyed by a toner conveyance screw in which the angular range θ=0°, that is, the toner conveyance screw does not have the cutout K, is "1" as a reference value, and the toner conveyance amounts in the respective cases are shown as relative amounts.

It can be known from FIG. 6 that the toner conveyance amount decreases as the angular range θ of the cutout K increases. As the angular range θ of the cutout K increases, the angular range where the conveyance blade 61 is present decreases inversely, and the capability of the conveyance blade 61 for conveying toner axially is reduced. The toner conveyance amount is particularly reduced when the angular range θ of the cutout K is 180° or greater. Therefore, when the angular range θ of the cutout K be less than 180°, the necessary toner conveyance amount (toner conveyance capability) can be secured.

Figure 7:
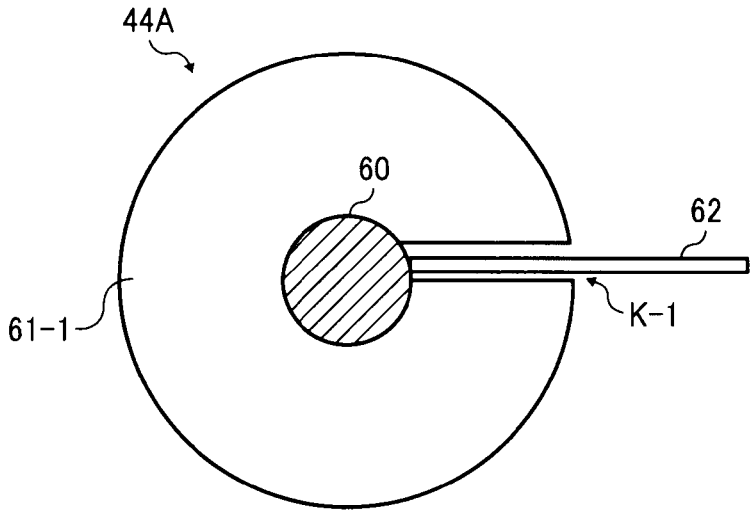
FIG. 7 illustrates a developer conveyance member according to a variation in which the angular range of the blade cutout is reduced.

FIG. 7 illustrates a developer conveyance member according to a variation in which the cutout is reduced in size. A developer conveyance member 44-A shown in FIG. 7 includes a cutout K-1 having an angular range reduced to an extent that the agitation blade 62 can be inserted therethrough. Reducing the cutout K in size can expand the range where the conveyance blade 61 is present, thus increasing the capability for transporting the toner axially. However, the margin for deformation of the agitation blade 62 is smaller in this configuration, and the load applied to the agitation blade 62 from the toner is increased.

Figure 8:
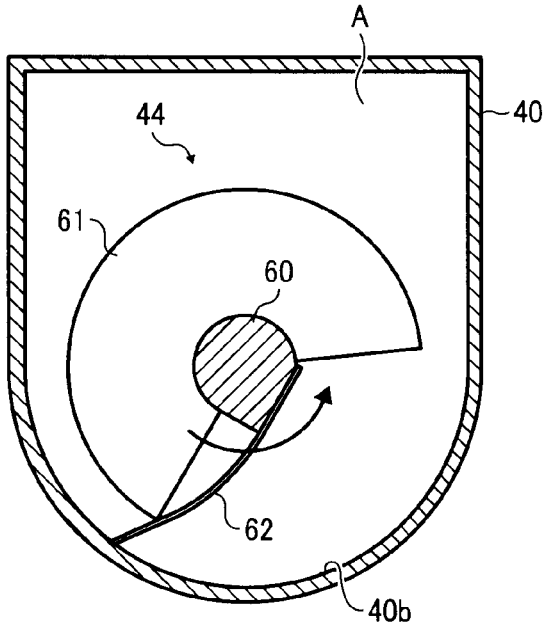
FIG. 8 illustrates the first developer conveyance member provided in the development housing.

FIG. 8 illustrates the first developer conveyance member 44 provided in the development housing 40.

In FIG. 8, reference character 40*b* represents the inner wall of the development housing 40. As shown in FIG. 8, a gap or clearance is provided between the conveyance blade 61 and the inner wall 40*b* of the development housing 40 forming the first compartment A. Although noise and abrasion is caused if the conveyance blade 61 that is not a flexible member contacts the inner wall 40*b* of the development housing 40, this configuration can eliminate such noise and abrasion.

By contrast, the agitation blade 62, which is a flexible member, is designed to contact the inner wall 40*b* of the development housing 40. That is, the agitation blade 62 has a width wider than the distance from the outer circumference of the rotary shaft 60 to the inner wall 40*b* of the development housing 40. With this configuration, while noise and abrasion are reduced, the toner present between the conveyance blade 61 and the inner wall 40*b* can be agitated and moved by the agitation blade 62. Additionally, when the inner wall 40*b* is arc-shaped in conformity to the locus of rotation of the agitation blade 62 as in the configuration shown in FIG. 8, dead space in which the agitation blade 62 cannot agitate the toner can be reduced.

Figure 9:
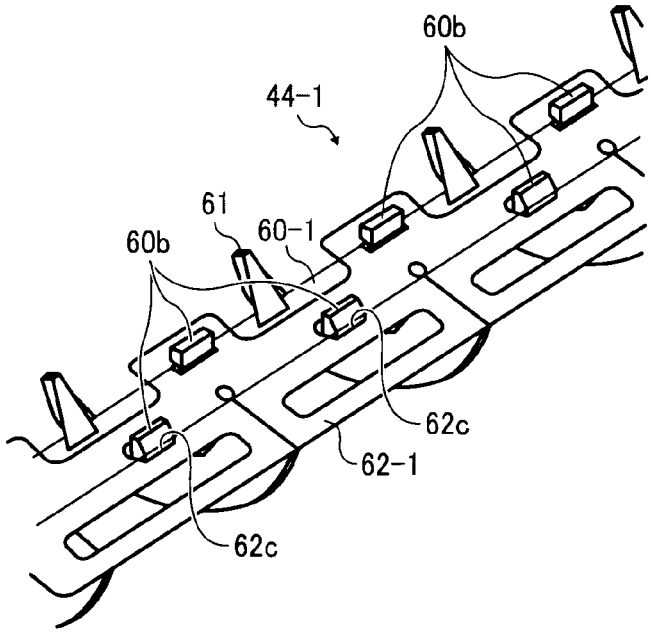
FIG. 9 is a perspective view of a first developer conveyance member according to another embodiment.
Figure 10A:
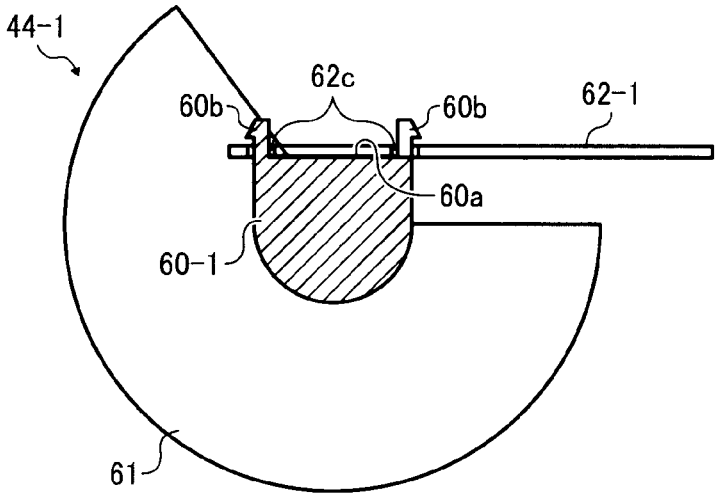
FIG. 10A is a cross-sectional view of the first developer conveyance member shown in FIG. 9 perpendicular to the axial direction thereof.
Figure 10B:
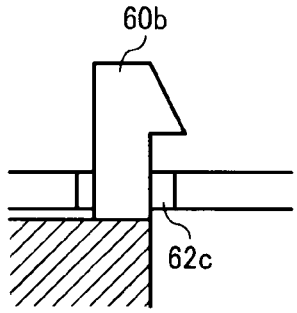
FIG. 10B is an enlarged view of the cross-section shown in FIG. 10A.

FIGS. 9, 10A, and 10B illustrate another embodiment in which the agitation blade is attached to the rotary shaft in a different manner from that in the above-described embodiment.

FIG. 9 is a perspective view of a first developer conveyance member 44-1 including an agitation blade 62-1 attached to a rotary shaft 60-1. FIG. 10A is a cross-sectional view of the first developer conveyance member 44-1 shown in FIG. 9 perpendicular to the axial direction thereof, and FIG. 10B is an enlarged view of the cross-section shown in FIG. 10A.

In the configuration shown in FIG. 9, the rotary shaft 60-1 includes multiple pawls 60*b* to attach the agitation blade 62-1 thereto, and multiple engagement holes 62*c* are formed in the agitation blade 62-1 to engage the respective pawls 60*b*. Thus, the agitation blade 62-1 can be attached to the rotary shaft 60-1 by fitting each pawl 60*b* in the engagement hole 62*c*.

This configuration can eliminate use of double-sided adhesive tape, which is used in the configuration shown in FIGS. 4 and 5, to attach the agitation blade 62-1 to the rotary shaft 60-1, thus simplifying the configuration and facilitating assembling. Additionally, when the pawls 60*b* loosely fit in the respective engagement holes 62*c* with play, the play can facilitate deformation of the agitation blade 62. It is to be noted the configuration shown in FIGS. 9 through 10B is similar to the configuration shown in FIGS. 4 and 5 other than the differences described above.

Although the above-described embodiments concern screws including spiral blades, alternatively, the feature of the above-described embodiments can adapt to developer conveyance members configured otherwise. For example, the above-described features of the present disclosure can adapt to a developer conveyance member 44-2 shown in FIG. 11 that includes a rotary shaft 60, planar fins 64 provided to the rotary shaft 60, and an agitation blade 62 provided to the rotary shaft 60. In other words, the developer conveyance member 44-2 includes multiple discontinuous sub-blades positioned obliquely to the rotary shaft 60.

Figure 11:
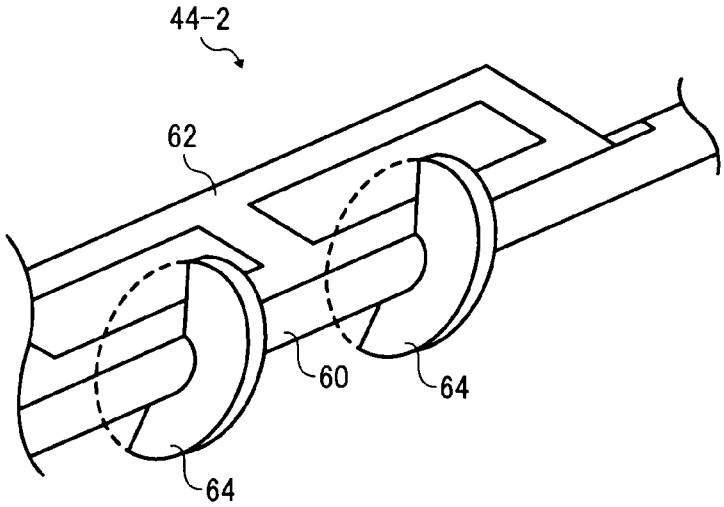
FIG. 11 illustrates a developer conveyance member according to a variation that includes planar fins provided on a rotary shaft.

In the configuration shown in FIG. 11, in the axial area where the agitation blade 62 is present, the fins 64 are cut out entirely in the direction of diameter, that is, from the outer circumference to the rotary shaft 60, and the agitation blade 62 is provided to the rotary shaft 60 in the portion where the fines 64 are cut out. Because the fins 64 are simpler in shape than the spiral-shaped conveyance blade 61, the component cost can be reduced.

Additionally, the second conveyance member 45 may have the above-described features. However, if only one of the first and second developer conveyance members 44 and 45 is selected to have the above-described features, the following advantages can be attained when the first developer conveyance member 44 is selected. The dead space in which developer accumulates tends to be greater in the first compartment A in which the development roller 41 is not provided compared with the second compartment B. Accordingly, when the first developer conveyance member 44 provided in the first compartment A has the above-described features, developer in the greater area of dead space can be agitated. Further, when the first developer conveyance member 44 has the above-described features, the developer in the dead space in the first compartment A can be agitated before transported to the second compartment B where the development range is positioned.

Additionally, the above-described features of this disclosure can adapt to developer conveyance members provided in the toner cartridge 50 or other components than the development device 4.

Although the description above concerns configurations using one-component developer, the above-described features of this disclosure can adapt to image forming apparatuses using two-component developer consisting essentially of carrier (carrier particles) and toner (toner particles). Moreover, the image forming apparatus to which the features of this disclosure are applied is not limited to multicolor laser printers but may be printers of other types, copiers, facsimile machines, or multifunction machines having these capabilities.

As described above, in the above-described embodiments, the agitation blade 62 is provided in the area where the conveyance blade 61 is provided in the axial direction of the rotary shaft 60. That is, the agitation blade 62 and the conveyance blade 61 overlap each other in the axial direction. Accordingly, the developer conveyance member 44 is capable of agitating developer as well as axially conveying developer in the same area. Therefore, accumulation of developer inside the development housing 40 can be prevented or reduced while conveyance of developer axially is secured.

Additionally, the agitation blade 62 is attached to the rotary shaft 60 and a grid frame or the like is not used in the connection therebetween. Therefore, the agitation blade 62 can extend relatively long in the direction of diameter. When the agitation blade 62 is relatively long in the direction of diameter, the margin for deformation of the agitation blade 62 can increase, reducing the contact pressure of the agitation blade 62 against the inner wall 40*b* of the development housing 40. Consequently, noise or abrasion can be reduced. Additionally, the pressure to the toner from the agitation blade 62 can be reduced, thus alleviating degradation of the toner.

Additionally, substantial changes in the shape of the rotary shaft 60 and the like are not necessary to use the grid frame or the like, and the structure can be simpler. Accordingly, the shape of the developer conveyance member can be changed easily for adjustment of developer conveyance capability or agitation capability. More specifically, when the area where the conveyance blade 61 is present is expanded by changing the angular range θ of the cutout K, the developer conveyance capability can increase. When the margin for deformation of the agitation blade 62 is changed by changing the angular range θ of the cutout K, the developer agitation capability can be adjusted.

When the angular range where the conveyance blade 61 is present is greater than 180° in the circumferential direction of the rotary shaft 60, a sufficient capability for transporting developer axially can be secured.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device for developing a latent image formed on a latent image bearer, the development device comprising:

a housing for containing developer;

a developer bearer to carry by rotation the developer contained in the housing to a development range position facing the latent image bearer; and a first developer conveyance device to transport the developer inside the housing, the first developer conveyance device including:

a rotary shaft;

a conveyance blade extending along the rotary shaft and projecting obliquely from the rotary shaft to transport developer as the rotary shaft rotates; and a flexible agitation blade provided to and extending along a length of at least a portion of the rotary shaft, wherein the flexible agitation blade and the conveyance blade overlap along the portion of the rotary shaft such that both of the flexible agitation blade and the conveyance blade are provided along the portion of the rotary shaft in an axial direction of the rotary shaft, and wherein the flexible agitation blade extends beyond an outer edge of the conveyance blade in a direction of a diameter of the rotary shaft.

2. The development device according to claim 1, wherein the rotary shaft comprises a flat face and the flexible agitation blade is attached to the flat face of the rotary shaft.

3. The development device according to claim 1, wherein the flexible agitation blade has one or more openings therein to let the developer pass therethrough.

4. The development device according to claim 1, wherein the conveyance blade extends over an angular range greater than 180 degrees around an outer circumference of the rotary shaft.

5. The development device according to claim 1, wherein the rotary shaft comprises a pawl, and an engagement hole is formed in the flexible agitation blade to engage the pawl of the rotary shaft.

6. The development device according to claim 1, wherein the conveyance blade comprises a spiral-shaped screw blade including a cutout extending from an outer circumference of the conveyance blade to the rotary shaft, and the agitation blade is disposed within the cutout.

7. The development device according to claim 6, wherein in a region of the cutout, the conveyance blade extends only partially around a circumference of the rotary shaft.

8. The development device according to claim 6, wherein the conveyance blade cutout extends from an outer circumference of the conveyance blade to the rotary shaft along an angular range such that an entirety of the conveyance blade is cutout in the angular range along the portion of the rotary shaft.

9. The development device according to claim 8, wherein the angular range of the cutout is less than 180°.

10. The development device according to claim 1, wherein the conveyance blade comprises discontinuous multiple sub-blades positioned obliquely to the axial direction of the rotary shaft and arranged along the rotary shaft, each of the multiple sub-blades includes a cutout extending from an outer circumference of the conveyance blade to the rotary shaft, and the agitation blade is disposed within the cutout.

11. The development device according to claim 1, wherein the agitation blade of the first developer conveyance device contacts an inner wall of the housing of the development device.

12. The development device according to claim 1, wherein a clearance is provided between the agitation blade and the conveyance blade positioned upstream from the agitation blade in a direction of rotation of the rotary shaft.

13. The development device according to claim 1, further comprising:

a partition that partially divided an interior of the housing into a first compartment and a second compartment; and a second developer conveyance device to transport the developer inside the second compartment axially, wherein a developer supply inlet through which the developer is externally supplied and the first developer conveyance device are provided in the first compartment, and the developer is circulated between the first compartment and the second compartment through multiple communication portions.

14. The development device according to claim 13, wherein the developer supply inlet is positioned on an upstream side in a direction in which the first developer conveyance device transports the developer.

15. The development device according to claim 1, wherein the flexible agitation blade has a width wider than a width of the conveyance blade.

16. A developer container comprising:

a housing for containing developer; and a developer conveyance device including:

a rotary shaft;

a conveyance blade extending along the rotary shaft and projecting obliquely from the rotary shaft to transport developer as the rotary shaft rotates; and a flexible agitation blade provided to and extending along a length of at least a portion of the rotary shaft, wherein the flexible agitation blade and the conveyance blade overlap along the portion of the rotary shaft such that both of the flexible agitation blade and the conveyance blade are provided along the portion of the rotary shaft in an axial direction of the rotary shaft, and wherein the flexible agitation blade extends beyond an outer edge of the conveyance blade in a direction of diameter of the rotary shaft.

17. The developer container according to claim 16, wherein the agitation blade of the developer conveyance device contacts an inner wall of the housing.

18. The developer container according to claim 16, wherein the flexible agitation blade has a width wider than a width of the conveyance blade.

19. An image forming apparatus comprising:

a latent image bearer on which a latent image is formed; and a development device including:

a housing for containing developer;

a developer bearer to carry by rotation the developer contained in the housing to a development range position facing the latent image bearer; and a first developer conveyance device to transport the developer inside the housing, the first developer conveyance device comprising:

a rotary shaft;

a conveyance blade extending along the rotary shaft and projecting obliquely from the rotary shaft to transport developer as the rotary shaft rotates; and a flexible agitation blade provided to and extending along a length of at least a portion of the rotary shaft, wherein the flexible agitation blade and the conveyance blade overlap along the portion of the rotary shaft such that both of the flexible agitation blade and the conveyance blade are provided along the portion of the rotary shaft in an axial direction of the rotary shaft, and wherein the flexible agitation blade extends beyond an outer edge of the conveyance blade in a direction of diameter of the rotary shaft.

20. The image forming apparatus according to claim 19, further comprising a developer container for containing developer, connectable to the development device.

21. The image forming apparatus according to claim 20, wherein the development device, the developer container, and the latent image bearer are housed in a common unit casing as a process unit.

22. The image forming apparatus according to claim 19, wherein the flexible agitation blade has a width wider than a width of the conveyance blade.

* * * * *